US006170663B1

(12) United States Patent
Glassman

(10) Patent No.: US 6,170,663 B1
(45) Date of Patent: Jan. 9, 2001

(54) CLAMSHELL PACKAGE INCLUDING THREE DIMENSIONAL INSERT

(75) Inventor: Ellen Tave Glassman, Haworth, NJ (US)

(73) Assignees: Sony Corporation, Tokyo (JP); Sony Electronics, Park Ridge, NJ (US)

( * ) Notice: Under 35 U.S.C. 154(b), the term of this patent shall be extended for 0 days.

(21) Appl. No.: 09/426,525

(22) Filed: Oct. 26, 1999

(51) Int. Cl.[7] ..... B65D 73/00
(52) U.S. Cl. ..... 206/461; 206/462; 206/471
(58) Field of Search ..... 206/232, 461, 206/462, 470, 471, 767

(56) References Cited

U.S. PATENT DOCUMENTS

| | | | |
|---|---|---|---|
| D. 219,429 | 12/1970 | Hill et al. | D9/99 |
| D. 238,674 | 2/1976 | Luodthe | D23/150 |
| D. 244,775 | 6/1977 | Wilson | D23/150 |
| D. 252,797 | 9/1979 | Fuller | D9/192 |
| D. 267,394 | 12/1982 | Liptak et al. | D9/415 |
| D. 273,565 | 4/1984 | Driskell et al. | D9/415 |
| D. 275,835 | 10/1984 | Borst | D9/415 |
| D. 313,753 | 1/1991 | Nagasaka | D9/415 |
| D. 332,216 | 1/1993 | Lee et al. | D9/415 |
| D. 332,398 | 1/1993 | Lee et al. | D9/415 |
| D. 348,391 | 7/1994 | Ichikawa et al. | D9/415 |
| D. 349,457 | 8/1994 | Nottingham et al. | D9/415 |
| D. 365,753 | 1/1996 | Sibbio | D9/415 |
| D. 400,096 | 10/1998 | Lee | D9/415 |
| 2,584,095 | 1/1952 | Slaughter | 229/5.5 |
| 3,025,958 | 3/1962 | Snape | 206/79 |
| 3,111,220 | 11/1963 | Bostrom | 206/47 |
| 3,192,681 | 7/1965 | Greenbaum | 53/30 |
| 3,375,921 | 4/1968 | Ligon | 206/80 |
| 3,463,309 | 8/1969 | Szostek | 206/78 |
| 3,497,059 | 2/1970 | Watts, Jr. | 206/78 |
| 3,685,649 | 8/1972 | Diehl | 206/78 |
| 3,747,830 | 7/1973 | Goldman | 229/21 |
| 3,927,762 | 12/1975 | Zdarsky et al. | 206/45.31 |
| 4,091,927 | 5/1978 | Lunsford | 206/459 |
| 4,161,246 | 7/1979 | Tanaka | 206/45.31 |
| 4,200,193 | 4/1980 | Boyle | 206/461 |
| 4,202,464 | 5/1980 | Mohs et al. | 220/339 |
| 4,210,246 | 7/1980 | Kuchenbecker | 206/461 |
| 4,213,531 | 7/1980 | Rae | 206/463 |
| 4,261,462 | 4/1981 | Wysocki | 206/45.31 |
| 4,300,682 | 11/1981 | Kuckenbecker | 206/461 |
| 4,356,919 | 11/1982 | Matney | 206/470 |
| 4,408,693 | 10/1983 | Brewaeys et al. | 206/461 |
| 4,423,811 | 1/1984 | Knapp | 206/362.3 |
| 4,453,629 | 6/1984 | Goldberg | 206/45.33 |
| 4,453,666 | 6/1984 | Gordon | 229/43 |
| 4,456,124 | 6/1984 | Kay et al. | 206/463 |
| 4,466,534 | 8/1984 | Dunn | 206/45.34 |
| 4,494,650 | 1/1985 | Cullen | 206/45.34 |
| 4,499,353 | 2/1985 | Shields | 206/470 |
| 4,512,474 | 4/1985 | Harding | 206/461 |
| 4,669,610 | 6/1987 | Lindsey et al. | 206/320 |
| 4,687,129 | 8/1987 | Cugley | 229/44 R |
| 4,699,291 | 10/1987 | Prais et al. | 220/319 |
| 4,724,964 | 2/1988 | Hernandez | 206/461 |
| 4,732,273 | 3/1988 | DeMarco | 206/470 |
| 4,739,883 | 4/1988 | Mohs et al. | 206/470 |
| 4,742,912 | 5/1988 | Lee | 206/459 |
| 4,753,340 | 6/1988 | Blakeman et al. | 206/44.11 |

(List continued on next page.)

*Primary Examiner*—David T. Fidei
(74) *Attorney, Agent, or Firm*—Wood, Herron & Evans, L.L.P.

(57) ABSTRACT

A clamshell package for holding and displaying a product including first and second clamshell members and an insert positioned within at least one of the first and second clamshell members. The insert includes a front panel, a pair of side panels and a bottom panel to not only obscure a portion or portions of the product from frontal view, but also to obscure view of the product or portions thereof from the sides and bottom of the package. In one alternative embodiment, a rear panel of the insert can obscure at least a portion of the product from rear view.

19 Claims, 3 Drawing Sheets

U.S. PATENT DOCUMENTS

| | | | |
|---|---|---|---|
| 4,804,984 | 2/1989 | Heuer et al. | 354/76 |
| 4,896,770 | 1/1990 | Calcerano et al. | 206/333 |
| 4,899,877 | 2/1990 | Kiernan | 206/349 |
| 4,944,435 | 7/1990 | Lee | 222/565 |
| 4,986,438 | 1/1991 | Borst | 220/315 |
| 4,989,548 | 2/1991 | Short et al. | 119/52.2 |
| 5,016,241 | 5/1991 | Lee et al. | 369/289 |
| 5,129,516 | 7/1992 | Theros | 206/463 |
| 5,129,517 | 7/1992 | Hustad | 206/467 |
| 5,143,215 | 9/1992 | Hartley et al. | 206/333 |
| 5,154,293 | 10/1992 | Gould | 206/461 |
| 5,209,354 | 5/1993 | Thornhill et al. | 206/469 |
| 5,297,679 | 3/1994 | Rondone et al. | 206/468 |
| 5,311,990 | 5/1994 | Kalinski | 206/370 |
| 5,435,447 | 7/1995 | Weatherford et al. | 206/349 |
| 5,447,232 | 9/1995 | Chow | 206/378 |
| 5,485,919 * | 1/1996 | Samberg et al. | 206/461 |
| 5,582,317 | 12/1996 | Wermund | 220/789 |
| 5,595,295 | 1/1997 | Lin | 206/349 |
| 5,669,549 | 9/1997 | Robertson | 229/4.5 |
| 5,788,105 | 8/1998 | Foos | 220/266 |
| 5,849,378 | 12/1998 | Gask | 428/35.7 |
| 5,865,013 | 2/1999 | Jackson | 53/474 |
| 5,875,893 * | 3/1999 | Lee et al. | 206/471 |
| 5,890,593 * | 4/1999 | Humphrey | 206/471 |
| 5,947,291 * | 9/1999 | Humphrey | 206/463 |
| 5,964,350 * | 10/1999 | LaMarche et al. | 206/470 |
| 6,039,495 * | 3/2000 | Zimmerman et al. | 206/470 |

* cited by examiner

CLAMSHELL PACKAGE INCLUDING THREE DIMENSIONAL INSERT

FIELD OF THE INVENTION

The present invention generally relates to packages for containing and displaying products and, more specifically, to so-called clamshell packages in which the product and an insert of associated graphics material are contained between two clamshell halves.

BACKGROUND OF THE INVENTION

Packaging for containing and displaying many consumer products is often formed as clamshell packaging or blister packs comprised of either one or two plastic members. These plastic members may have one or more bubbles, blisters or pockets which house the product and any associated product accessories. Often times, a singular plastic sheet may be held to a cardboard sheet having various printed product information, illustrations, advertising for consumer marketing purposes and having a slot or hole to allow suspension of the package from a hook of a display rack. Some blister packages incorporate flat display cards contained between two transparent clamshell halves.

Especially when using completely transparent clamshell halves, it may be desirable to expose certain portions of a product, while concealing other portions of the product or product accessories so that they are not visible to the customer. For example, the wiring, batteries or other electrical components of a portable audio product may not be desirable as display items, while the main portion of a product, such as an audio unit, should be visible to consumers. Current packaging configurations of the clamshell or blister pack type can conceal too much or too little of the product. For instance, in a conventional clamshell packaging configuration for electrical consumer products, a planar paperboard insert may be used to conceal portions of the product from frontal view. However, this type of insert will not conceal the view from the sides, bottom or rear of the packaging. Therefore, the consumer can still see a large portion of the associated electrical hardware, such as electrical cords, electrical adapters, etc., and will focus less of their attention on the main product itself.

It would therefore be desirable to provide a clamshell package for containing and displaying only the main portion or portions of a product, and preventing accessories from being viewed from the front and sides and preferably, the bottom. Optionally, it would be desirable to selectively conceal the view of a portion of the product from the rear. In general, it would be desirable to combine a transparent clamshell package with three-dimensionally shaped pockets or blisters for holding a product with a three-dimensional insert that obscures the consumer's view of at least certain product components from more than just a frontal view.

SUMMARY OF THE INVENTION

In one general aspect, the present invention therefore provides a clamshell package for holding and displaying a product and facilitating the general objective of combining clamshell halves with a three dimensional insert, such as a paper or plastic material insert, that obscures view of at least certain portions of the product from the front as well as the sides. More preferably, portions of the front, sides and bottom of the package contents are obscured from view. In yet another aspect of the invention, at least a certain portion of the rear of the package contents is obscured from view by a rear panel associated with the insert.

More specifically, the invention generally comprises a clamshell package including a first outer clamshell member having a first three dimensional pocket area for holding at least a portion of a product. The first outer clamshell member includes a front portion, a pair of side portions and a bottom portion, each preferably being transparent. A second outer clamshell member includes a second three dimensional pocket area for holding at least another portion of the product. As used herein, the term product encompass a main product, such as a portable audio unit, and any other product accessories or components. An insert is positioned within at least one of the first and second outer clamshell members and includes a front panel, a pair of side panels and a bottom panel connected together. The front panel is disposed adjacent the front transparent portion of the outer clamshell member. The side panels are respectively disposed adjacent the side portions of the first outer clamshell member and the bottom panel is disposed adjacent the bottom portion of the first outer clamshell member. In accordance with this general package configuration, at least the first clamshell member may be formed of completely transparent material, such as polyvinylchloride (PVC), and various portions of the product may be obscured from view in three dimensions. The insert may include an aperture for allowing a desirable portion or portions of the product to be viewed from the front, while the remaining portions of the front panel, side panels and bottom panels may prevent a customer from viewing other less cosmetically appealing important portions of the product from the front, sides and bottom of the package.

In the preferred embodiment, each of the first and second outer clamshell members is formed entirely from a transparent material such as PVC. Each clamshell member includes a central, three dimensionally molded portion and these central portions align to form at least one pocket area for holding the product. The clamshell members further include mating surfaces positioned peripherally outside of the central portions. These mating surfaces are adapted to be sealed together, such as through an adhesive, heat, or ultrasonic sealing method. To facilitate a free-standing package structure, two of the mating surfaces may define a bottom sealing edge which forms a lower support edge and the bottom portion of the front panel can further include at least two feet that combine with the lower support edge to allow the package to be free-standing. The two clamshell members may further include aligned apertures in upper portions thereof for receiving a hook to allow the package to be suspended and displayed.

As a more specific feature of the insert, the front panel may be curved or angled in a nonplanar manner to generally conform to the front portion of the first transparent outer clamshell member. The side panels of the insert can likewise include angled or curved front edges to follow the shape of the front panel. The front panel may further include at least one aperture for exposing at least a portion of the product contained in the package. To facilitate easy manufacturing of the insert, the insert is preferably comprised of a single sheet of material, such as paper, paperboard, cardboard or plastic, with the side and bottom panels folded relative to the front panel.

In another embodiment, the insert may further comprise a rear panel which is connected and folded relative to one of the other panels, such as the bottom panel. In each embodiment, the front, bottom, side and rear panels are preferably formed from an opaque material, which may have graphics on outer surfaces thereof, to obscure at least a portion of the product from the corresponding front, bottom, side and/or rear portions of the package.

Additional features, advantages and objectives of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
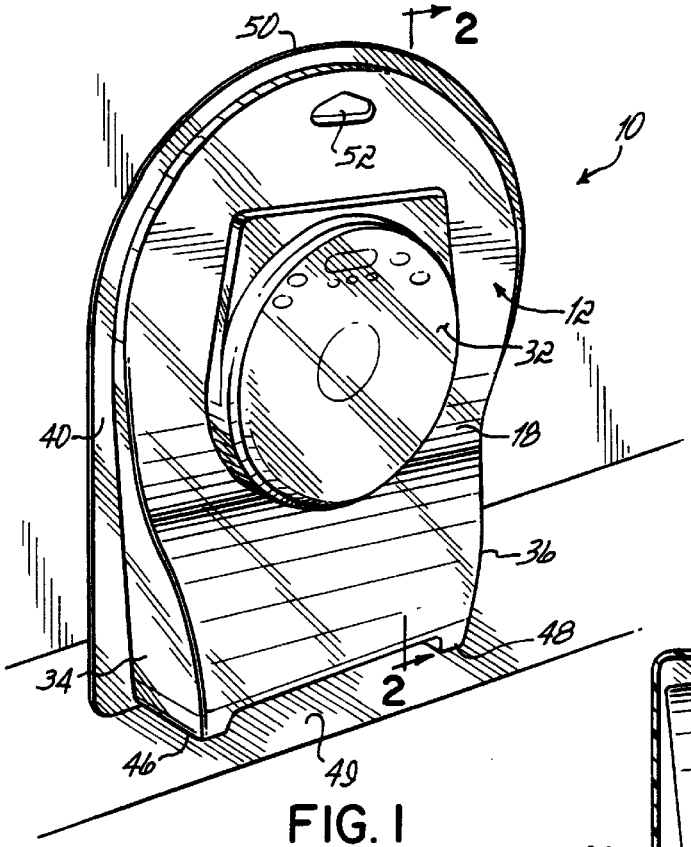
FIG. 1 is a perspective view of a package containing a portable audio product and constructed in accordance with a preferred embodiment of the invention.
Figure 2:
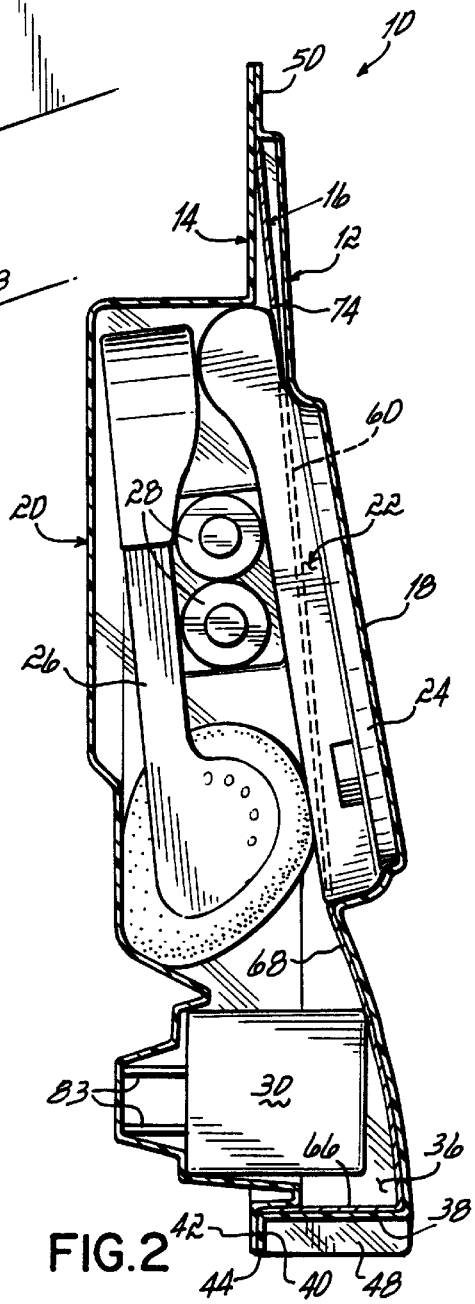
FIG. 2 is a cross sectional view taken along line 2—2 of FIG. 1.
Figure 3:
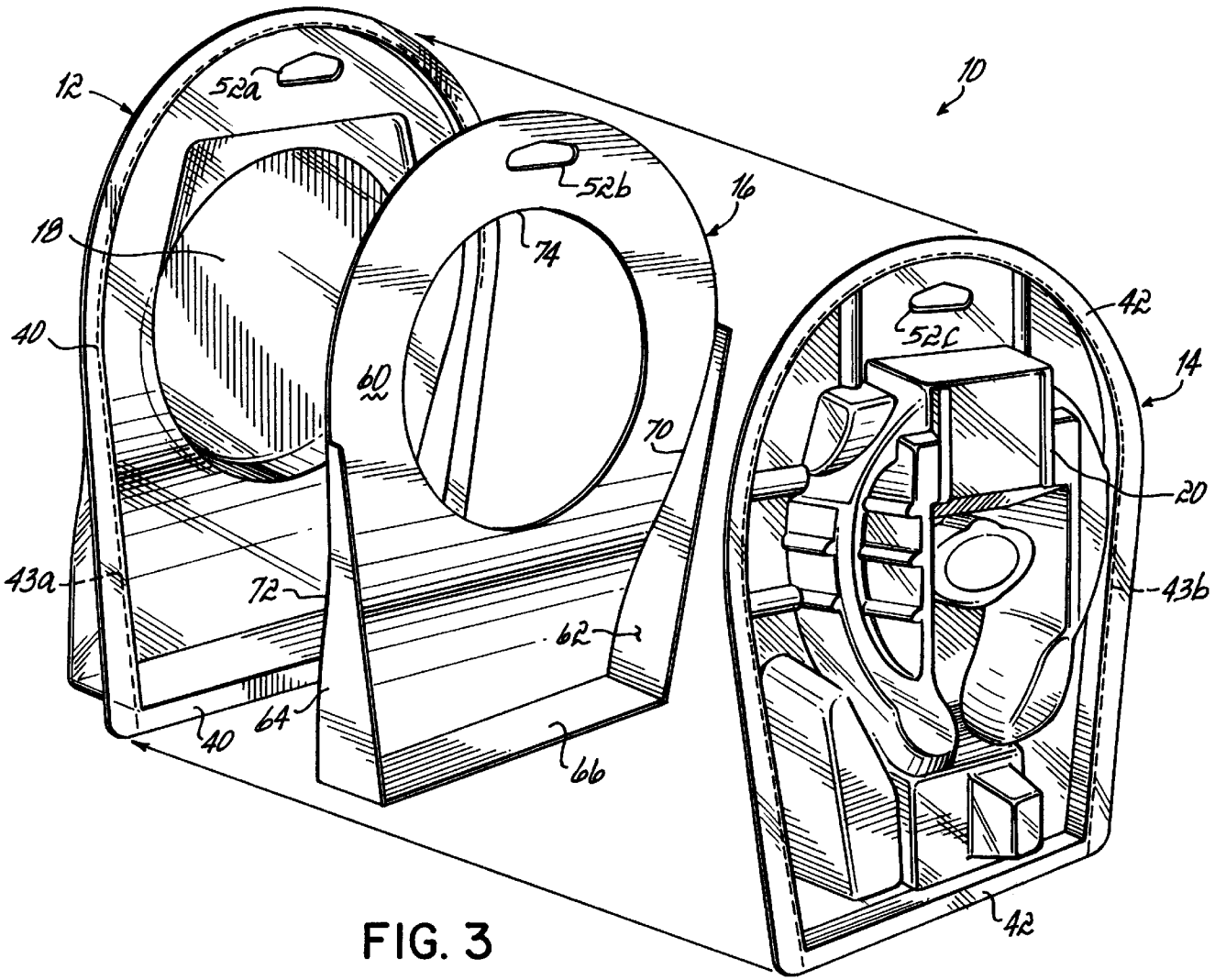
FIG. 3 is an exploded perspective view of the preferred package construction of FIG. 1 with the product deleted for clarity.

Referring first to FIGS. 1–3, a clamshell package 10 constructed in accordance with the preferred embodiment includes a first transparent outer clamshell member 12, a second transparent outer clamshell member 14, and an insert 16. Insert 16 may be formed of any desirable thin sheet material, such as paper, paperboard, cardboard or other paper-based material or a plastic. The outer surfaces of insert 16 may include various advertising information, product information, illustrations, etc., related to the product to be packaged. First outer clamshell member 12 includes a first three dimensional pocket area 18 and second outer clamshell member 14 includes a second three dimensional pocket area 20 for holding various portions of a product 22. In this illustrative example, product 22 includes a portable compact disc unit 24, a pair of headphones 26, batteries 28 and an AC adapter 30. It will be understood that other products, including other portable electric or electronic products, may be packaged in accordance with the invention and that package 10 and its pocket areas 18, 20 would be modified in shape and size according to each product application.

First outer clamshell member 12 includes a front portion 32, a pair of side portions 34, 36, and a bottom portion 38. These portions generally define the first three dimensional pocket area 18. First clamshell member 12 includes a mating sealing area 40 disposed peripherally outside of first three dimensional pocket area 18 and, likewise, second clamshell member 14 includes a mating sealing area 42 disposed peripherally outside of second three dimensional pocket area 20. As shown in FIG. 3, clamshell members 12, 14 include aligned perforations 43*a*, 43*b* disposed between sealing areas 40, 42 and three dimensional pocket areas 18, 20. Perforations 43*a*, 43*b* allow a customer to cut away sealing areas 40, 42 to access product 22.

Mating sealing areas 40, 42 in part form a bottom sealing edge 44 which may be used as a lower support edge together with a pair of feet 46, 48. Edge 44 and feet 46, 48 allow package 10 to be freestanding, such as for display purposes on a shelf 49. Proximate an upper sealing edge 50, a hook aperture 52, comprised of respective apertures 52*a*, 52*b*, 52*c* (FIG. 3), allows package 10 to be alternatively displayed on a hook associated with a display rack (not shown).

Figure 4:
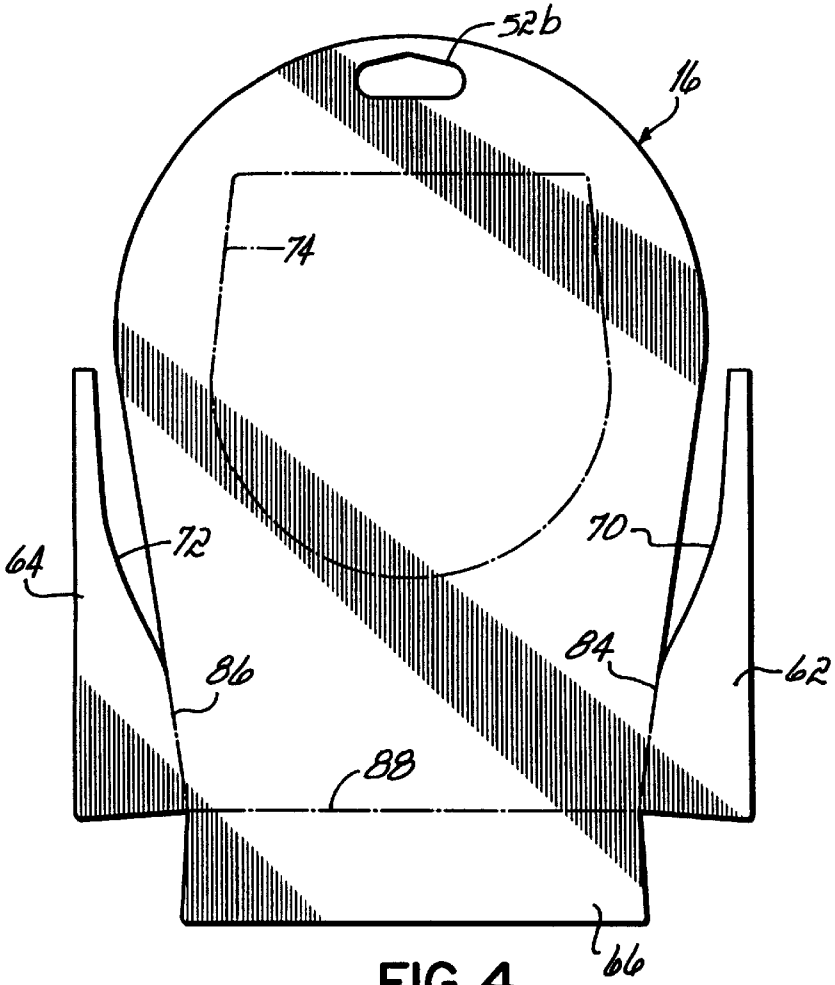
FIG. 4 is a plan view of the insert, shown in a flat or planar condition, as used the preferred embodiment.

As best shown in FIGS. 3 and 4, insert 16 includes a front panel 60, a pair of opposite side panels 62, 64 and a bottom panel 66. Front panel 60 includes a curved portion 68 that makes front panel 60 nonplanar in order to follow a nonplanar shape of the interior of clamshell member 12. Alternatively, this curved portion may comprise an angled portion or a plurality of angled and/or curved portions. Side panels 62, 64 include front edges 70, 72 which are likewise curved or otherwise shaped to correspond to the shape of the front panel 60. Side panels 62, 64 and bottom panel 66 mainly conceal AC adapter 30 and its electrical cord (not shown) from view at the sides and bottom of package 10. Various configurations and shapes may be used for the different panels of insert 16 to provide more or less product concealment. Front panel 60 may include an aperture 74 to receive and/or simply expose product 22 or a portion thereof. As more specifically shown in FIG. 2, aperture 74 allows a portable compact disc unit 24 to extend at an angle through front panel 60 of insert 16 and into first three dimensional pocket area 18 at an angle so as to highlight the slimness of compact disc unit 24.

Figure 6:
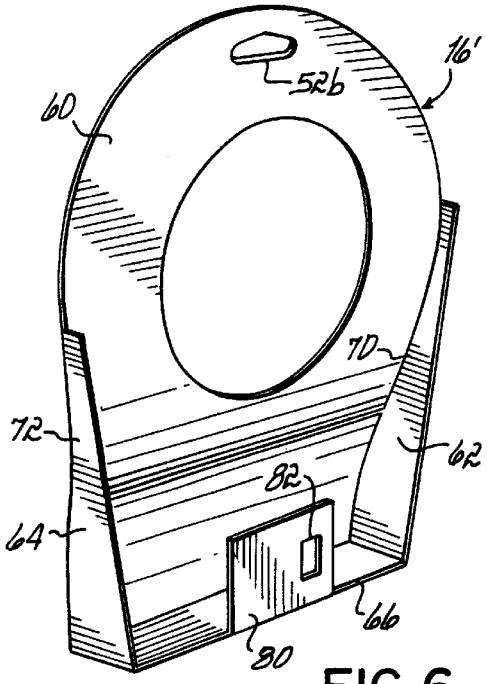
FIG. 6 is a perspective view of the insert shown in FIG. 5 as used in a folded condition.
Figure 5:
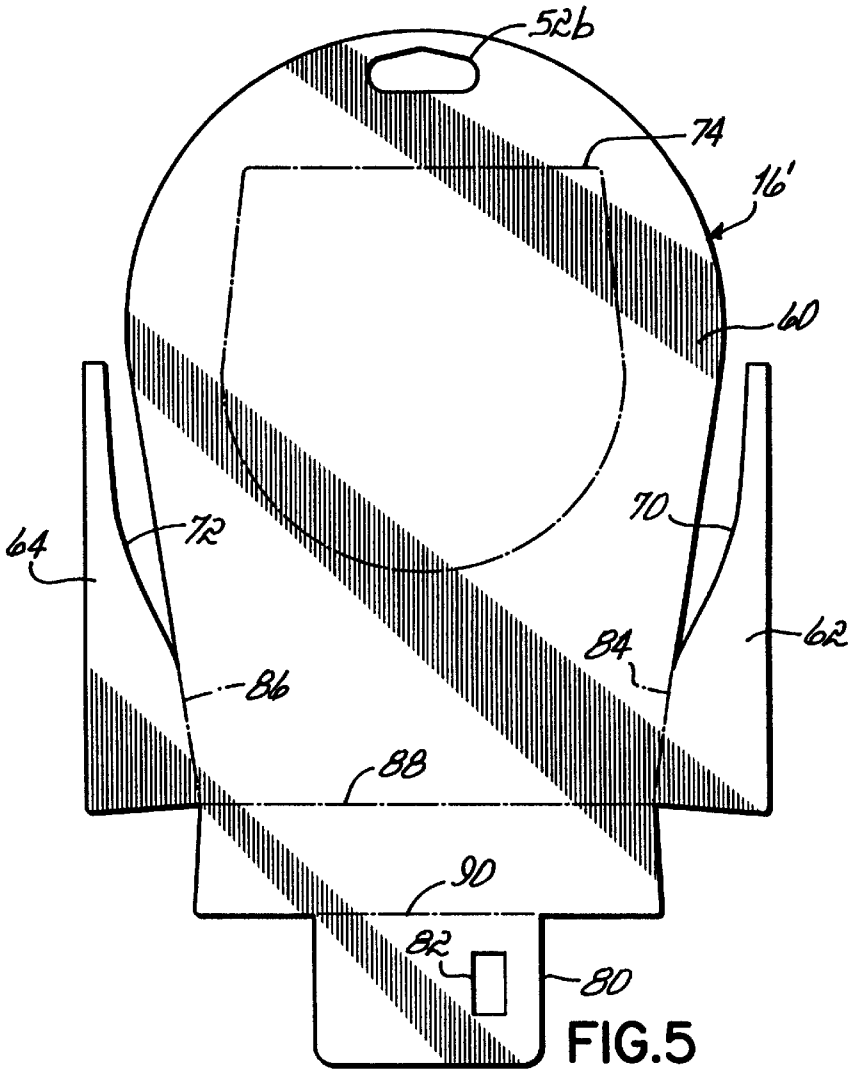
FIG. 5 is a plan view of an alternative insert including a rear panel.

As further shown in FIGS. 5 and 6, one alternative insert 16' includes all of the same panels as the first embodiment, as indicated by the like reference numerals, and also includes a rear or back panel 80 for allowing concealment of at least a portion of product 22 from the rear. In this illustrative example, the portion of product 22 obscured from the rear is AC adapter 30, although an aperture 82 is provided to receive electrical prongs 83 (FIG. 2) for clearance purposes. It will be understood that one or more connected rear panel portions may be used to conceal any desired portions of a product from rear view. Insert 16 and insert 16' each include fold lines 84, 86, 88 for allowing the respective inserts 16, 16' to be folded into three dimensional configurations as respectively shown in FIGS. 3 and 6. Insert 16' further includes a fold line 90 allowing back panel 80 to be folded upwardly relative to bottom panel 66, as shown in FIG. 6.

While the present invention has been illustrated by a description of the preferred embodiments and while these embodiments have been described in some detail, it is not the intention of the Applicant to restrict or in any way limit the scope of the appended claims to such detail. Additional advantages and modifications will readily appear to those skilled in the art. This has been a description of the present invention, along with the preferred methods of practicing the present invention as currently known. Various aspects of this invention may be used alone or in different combinations.

The scope of the invention itself should only be defined by the appended claims, wherein I claim:

1. A clamshell package for holding and displaying a product, the package comprising:

a first transparent outer clamshell member having a first three dimensional pocket area for holding at least a portion of a product, the first outer clamshell member having a transparent front portion, a pair of transparent side portions and a transparent bottom portion, a second outer clamshell member having a second three dimensional pocket area for holding another portion of said product, and a three dimensional insert for concealing at least a portion of said product, said insert positioned within at least one of the first and second outer clamshell members and including a front panel, a pair of side panels and a bottom panel connected together, said front panel being disposed adjacent the front portion of said first transparent outer clamshell member, said pair of side panels being disposed adjacent the side portions of said first transparent outer clamshell member, and said bottom panel being disposed adjacent the bottom portion of said first transparent outer clamshell member.

2. The package of claim 1, wherein the clamshell members include mating surfaces adapted to be sealed together and positioned peripherally outside of said three dimensional pocket areas.

3. The package of claim 2, wherein two of the mating surfaces further define a bottom sealing edge which forms a lower support edge, and the bottom portion of the front panel further includes at least two feet that combine with the lower support edge to allow the package to be free standing.

4. The package of claim 1 further comprising aligned apertures in upper portions of the first and second outer clamshell members for receiving a hook to allow the package to be suspended and displayed.

5. The package of claim 1, wherein the front panel of said insert includes a nonplanar portion conforming generally to the front portion of said first transparent outer clamshell member, and the side panels of said insert include front edges that follow the nonplanar portion of said front panel.

6. The package of claim 5, wherein the front panel of said insert includes at least one aperture for exposing at least a portion of said product.

7. The package of claim 1, wherein the front panel of said insert includes at least one aperture for exposing at least a portion of said product.

8. The package of claim 1, wherein said insert further comprises a single sheet of material with said side and bottom panels folded relative to said front panel.

9. The package of claim 1, wherein said transparent outer clamshell members are formed from blow-molded plastic material and said insert is formed from a paper material.

10. The package of claim 1, wherein said second outer clamshell member is transparent.

11. A clamshell package for holding and displaying a product, the package comprising:

a first transparent outer clamshell member having a first three dimensional pocket area for holding a portion of a product, the first outer clamshell member having a front portion, a pair of side portions and a bottom portion including at least one supporting surface allowing said first and second transparent outer clamshell members to stand freely upright on a planar surface when said product is packaged therein, a second transparent outer clamshell member secured to said first transparent outer clamshell member and having a second three dimensional pocket area for holding another portion of said product, and a three dimensional insert for concealing at least a portion of said product, said insert positioned within at least one of the first and second outer clamshell members and including a front panel, a pair of side panels and a bottom panel connected together, said front panel being disposed adjacent the front portion of said first transparent outer clamshell member, said pair of side panels being disposed adjacent the side portions of said first transparent outer clamshell member, and said bottom panel being disposed adjacent the bottom portion of said first transparent outer clamshell member.

12. The package of claim 11, wherein the clamshell members include mating surfaces adapted to be sealed together and positioned peripherally outside of said three dimensional pocket areas.

13. The package of claim 12, wherein two of the mating surfaces further define a bottom sealing edge which forms one of said supporting surfaces, and the bottom portion of the front panel further includes at least two feet that combine with the bottom sealing edge to allow the package to be free-standing.

14. The package of claim 11 further comprising aligned apertures in upper portions of the first and second outer clamshell members for receiving a hook to allow the package to be suspended and displayed.

15. The package of claim 11, wherein the front panel of said insert includes a nonplanar portion conforming generally to the front portion of said first transparent outer clamshell member, and the side panels of said insert include front edges that follow the nonplanar portion of said front panel.

16. The package of claim 15, wherein the front panel of said insert includes at least one aperture for exposing at least a portion of said product.

17. The package of claim 15, wherein said insert further comprises a single sheet of material with said side and bottom panels folded relative to said front panel.

18. The package of claim 17, wherein said insert further includes a rear panel formed as part of said single sheet of material and folded relative to said bottom panel.

19. The package of claim 15, wherein said transparent outer clamshell members are formed from blow-molded plastic material and said insert is formed from a paper material.

* * * * *